US005383310A

United States Patent [19]

Sapia

[11] Patent Number: 5,383,310

[45] Date of Patent: Jan. 24, 1995

[54] DEBRIS-FREE RAIN GUTTER COVER SYSTEM

[76] Inventor: John A. Sapia, 69 Locust Point Rd., Locust, N.J. 07760

[21] Appl. No.: 145,105

[22] Filed: Nov. 3, 1993

[51] Int. Cl.[6] ..... E04D 13/00

[52] U.S. Cl. ..... 52/12; 52/11

[58] Field of Search ..... 52/12, 11, 16; 210/473, 210/474

[56] References Cited

U.S. PATENT DOCUMENTS

| | | | |
|---|---|---|---|
| 3,950,951 | 4/1976 | Zukauskas | 52/12 X |
| 4,411,110 | 10/1983 | Carey | 52/12 X |
| 4,435,925 | 3/1984 | Jefferys | 52/12 |
| 4,467,570 | 8/1984 | Kriegel | 52/12 |
| 4,497,146 | 2/1985 | Demartini | 52/11 X |
| 4,616,450 | 10/1986 | Shouse | 52/12 |
| 4,866,890 | 9/1989 | Otto | 52/12 |
| 4,876,827 | 10/1989 | Williams | 52/12 |
| 5,099,620 | 3/1992 | Carey | 52/12 |
| 5,216,851 | 6/1993 | Kuhns | 52/12 |
| 5,251,410 | 10/1993 | Carey | 52/12 |

*Primary Examiner*—Carl D. Friedman
*Assistant Examiner*—Robert J. Canfield
*Attorney, Agent, or Firm*—Charles I. Brodsky

[57] ABSTRACT

A cover for a hollow rain gutter having an upwardly pitched top surface arranged to seat beneath the shingles of a roof at which the gutter has previously been secured, a downwardly pitched front surface extending towards the trough of the gutter, and a bottom surface extending towards the front lip of the gutter, in a horizontal plane below such lip—and in which rows of interrupted slots run horizontally along the front and bottom surfaces of the cover, to divert rainwater received across the top surface into the trough of the gutter. The dimensions of the interrupted slots are selected sufficiently small to keep leaves, rocks, twigs, etc. from entering the gutter while allowing the rainwater to flow smoothly.

13 Claims, 1 Drawing Sheet

DEBRIS-FREE RAIN GUTTER COVER SYSTEM

FIELD OF THE INVENTION

This invention relates to rain gutters and, more particularly, to a cover for preventing undesired entry of leaves and other debris of a tendency to cause clogging and stoppage of rainwater flow through the downspouts which are connected thereto.

BACKGROUND OF THE INVENTION

U.S. Pat. No. 5,099,620—Carey—describes a rain gutter cover construction said to offer particular advantage in preventing leaves, twigs and other debris from entering the gutter and stopping rainwater flow into the connected downspouts. One problem existing with such construction, however, was that the narrow slots that were employed themselves easily became clogged—especially when the installation was on a dwelling or building surrounded by pine trees or honey locust trees whose needles and sap tended to clog up the openings; in such situations, it was found necessary to brush those slots clear periodically, sometimes up to three times per year. This, and other problems associated with such construction were overcome, by the use of a rain gutter cover of a new and unique type, described in my pending Application, Ser. No. 07/935,978, filed Aug. 27, 1992, and now U.S. Pat. No. 5,305,562, issued on Apr. 26, 1994.

In considering this matter further, the realization came to mind that the difficulty encountered resulted from a compromise in dimensioning the slots employed to allow rainwater to enter easily, while making it difficult for leaves, twigs, needles and other debris to pass. That is, by having the slots large so as to capture as much rainwater as possible, it became easier for the unwanted debris to enter as well; conversely, by making the slots small enough to keep out as much debris as acceptable, a concomitant decrease in the captured rainwater followed. Some alternative to this would thus be desired—because if the slots were made sufficiently small to keep out the debris, the rainwater which would not be diverted into the trough of the gutter would continue to cascade over the front of the gutter, and would form icicles during the cold weather season.

Investigation showed another need for an improvement in the described construction of U.S. Pat. No. 5,099,620, in that the repeated oscillation of the sheet-metal construction employed under the repeated forces of wind, rain and snow produced a measurable tendency for a weakening of the construction, and, thus, a reasonably expected shortened lifetime.

OBJECTS OF THE INVENTION

It is an object of the invention, therefore, to provide a new and improved rain gutter cover which easily allows the capture of rainwater for diversion into a gutter, but which keeps the entry of debris to a minimum.

It is another object of the invention to provide such a rain gutter cover which is of a construction to permit its fabrication of sheet-metal, aluminum or aluminum-alloy material, but which provides added support during windy and bad-weather conditions.

SUMMARY OF THE INVENTION

As will become clear from the description that follows, a cover for a hollow rain gutter, according to the invention, has an upwardly pitched top surface arranged to seat beneath the shingles of a roof at which the gutter has previously been secured, a bottom surface, and a downwardly pitched front surface joining the two, and a first row of interrupted slots running horizontally along the front surface of the cover. Whether one believes that it might be desirable to incorporate two or more rows of interrupted slots in the front surface as shown in U.S. Pat. No. 5,099,620 (in connection with which the present invention will continue to operate as described below) instead of the single row of slots as illustrated, the present invention further incorporates, and as will be seen, a second row of interrupted slots running horizontally in the bottom surface of the cover, and below the front lip of the gutter. As will be appreciated, reducing the size of both these rows of spaced-apart slots reduces the propensity for them to accept debris, while having the second row below the bottom lip of the gutter acts to ensure that any rainwater not captured by the slots in the front surface are captured by the slots in the bottom surface—which, of necessity, then only flow into the gutter beneath it, and which cannot rise over the front of the gutter and cascade down to the ground, as the bottom surface of the cover lies in a plane below that of the front lid. As will be seen in the embodiments of the invention described below, one version of the invention has the bottom edges of the slots in the front surface vertically disposed with respect to the slots in the bottom surface, thereby providing, in essence, a bulkhead, or wall, which provides a degree of support to the cover against the elements. In a second embodiment, the bottom surface of the cover will be seen to be integrally fabricated with the front surface by a bending action which in actuality divides the front surface horizontally interrupted slots into both rows of slots in the front and bottom surfaces—but, there, a support strip is included to itself extend horizontally across the front surface at that point of bending, in strengthening the cover in resistance to the actions of wind, snow and rain in shaking the front surface to-and-fro.

With either construction—and in a manner to be described hereinafter, the spaced-apart horizontal slots are selected of a dimension sufficiently small to keep out almost all debris from entering the gutters and clogging the downspouts, yet the two rows of horizontally interrupted slots cooperate to capture substantially all the rainwater flow hitting the top surface of the cover and directing it down the top, along the front and bottom surfaces, and into the trough.

BRIEF DESCRIPTION OF THE DRAWINGS

These and other features of the invention will become clear from a consideration of the following description, taken in connection with the accompanying drawings, in which.

DETAILED DESCRIPTION OF THE DRAWINGS

Figure 1:
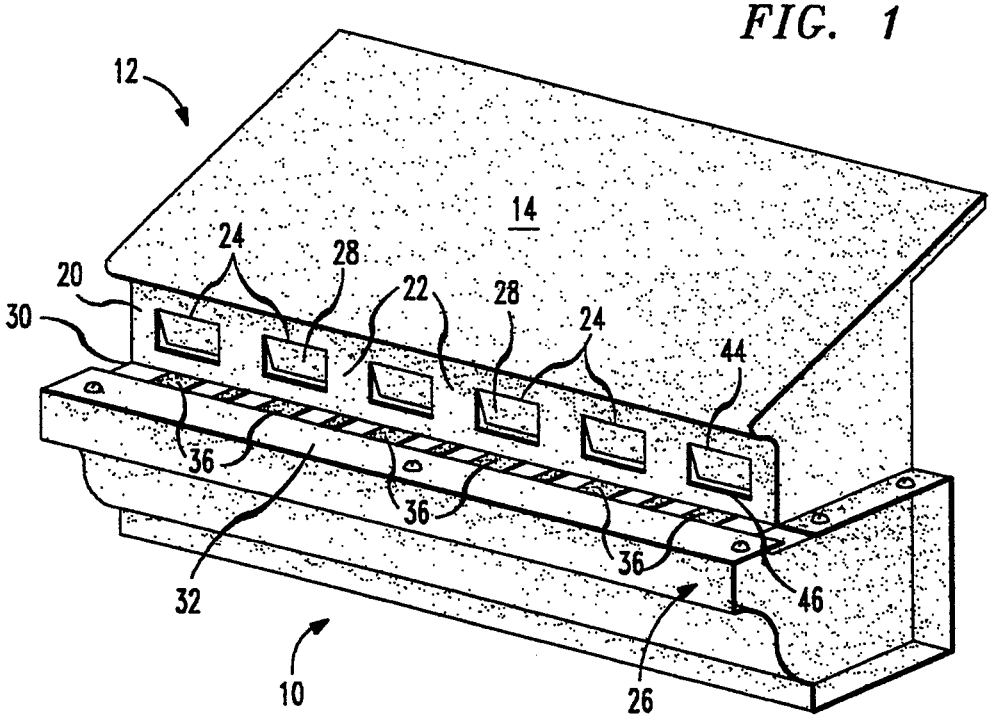
FIG. 1 is a perspective view of a debris-free cover for a rain gutter embodying the principles of the present invention.
Figure 3:
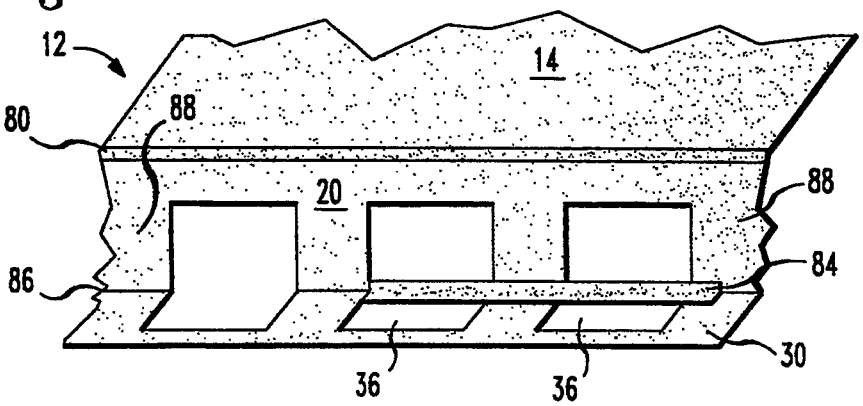
FIG. 3 is a partial perspective view of the cover of FIG. 1, in accordance with a second embodiment utilizing the principles of the invention.

In FIGS. 1 and 3, reference numeral 10 identifies the existing rain gutter, while reference numeral 12 identifies the cover to be utilized therewith, in accordance with the teachings of the invention. As will be seen, the cover 12 includes an upwardly pitched top surface 14 arranged to seat under the shingles of a roof (not shown) or just to extend to reach the facia board 18 of a building that does not have a shingled-roof fabrication. The cover 12 is shown as having a downwardly pitched front surface 20 including a row 22 of spaced-apart, horizontally interrupted slots 24. (Although a single row 22 of these slots are shown, a plurality of longitudinally extending rows of interrupted slots may be employed as shown in the aforementioned U.S. Pat. No. 5,099,620, wherein the interruptions between the individual slots 24 are displaced horizontally with respect to the interruptions between the slots of the next adjacent row.)

Also shown, and in accordance with the teachings of the invention, are a plurality of flaps 28 which are bent inwardly and downwardly in the front surface 20, towards the trough 26, to guide rainwater flow by surface adhesion inwardly of the gutter 10. As will be appreciated, such flaps 28 are generally of the width of the slot 24 from which they are stamped, and extend inwardly a limited amount—typically ½". As will be appreciated, such limited amount restricts the possibility of any debris travveling along the flap 28 that might otherwise fall by gravity into the trough 26—but at the same time limits the amount of rainwater that can be captured. Conversely, increasing the size of the slot 24 to increase the ability to capture this rainwater flow also increases the amount of leaves, twigs, pine needles, and other debris which can enter, clog the gutter and eventually clog the downspouts.

While U.S. Pat. No. 5,099,620 suggests the use of a plurality of rows of these slots to alternately collect the rainwater and debris, experience has shown that the slots must continue to be periodically cleared, as by cleaning them with a stiff bristle brush several times each year. Obviously, if it is desired to collect as much rainwater flow as possible, while at the same time, keep out as much debris as possible, either some compromise must be made in selecting the dimensions of the interrupted slots 24, or in their utilizations.

In accordance with the invention, the rain gutter cover 12 also includes a bottom surface 30 extending from the front surface 20 in a direction towards the lip of the rain gutter 32, and in a horizontal plane below it. In particular, a second row of spaced-apart, interrupted slots 36 is provided in the bottom surface 30 horizontally extending across the front surface 20 and eccentrically placed with respect to the row 22 of interrupted slots 24. As will be more clearly seen from the drawings, furthermore, the width 38 of the horizontally interrupted slots 24 is greater than the width 40 of the horizontally interrupted slots 36, more than twice as much. As will also be seen, preferably the height 42 of the horizontally interrupted slot 24 measured between its upper and lower edges 44, 46 respectively, is likewise greater than the length 48 of the horizontally interrupted slots 36, measured between its forward and rearward edges, 50, 52, respectively. As will also be seen, the opposing edges 54, 56 of any two adjacent slots 58, 60 in the bottom surface 30 extend beyond the corresponding opposing edges 62, 64 of an adjacent slot 66 in the front surface 20, and by an amount indicated by reference numeral 68.

In the aforedescribed manner, therefore, it will be appreciated by those skilled in the art that any rainwater hitting the top surface 14 of the cover 12 which "misses" flowing into the slots 24—and particularly into adjacent slot 66—then flows along the vertical wall interruptions 72 until they meet the bottom surface 30, and then continue to flow through the slots 36 into the trough 26—and, particularly, through adjacent slots 58, 60. Such "rainwater misses" will be appreciated as not being able to cascade over the lip 32 of the gutter 10 and "waterfall" down to the ground, as the horizontal plane of the bottom surface 30 lies below the horizontal plane of the lip 32. In actuality, the rearward edge 52 of the bottom surface slots 36 could, if desired, be in a horizontal plane above that of the lip 32 of the gutter 10, but as long as at least the forward edge 54 of the slot 36 is below the plane of the lip 32, any rainwater must fall by gravity into the trough 26.

In accordance with the teachings of the invention, the dimensions selected for the slots 24 and 36 were chosen to keep the area small to prevent entry of most leaves, twigs, etc., but the offsetting of the slots 24 in the front surface 20 with those slots 36 of the bottom surface 30 continues to present the greatest possibility of rainwater entry into the trough 26. In one embodiment of the invention, the width 38 of the interrupted slot 24 was selected 1¼", and of a height 42 of the order of ½". At the same time, the length 40 and length 48 of the slot 36 were each selected substantially ½" in dimension. The extend 70 in this construction was selected 1/8"—but such dimensions are for purposes of illustration only and are not to be dispositive of the invention. With this arrangement, the reduced sizes selected for the slots 24 and 36 effectuate an optimum compromise in allowing a large amount of rainwater to flow into the trough 26, while keeping out a very large amount of debris that might otherwise congregate and enter into the gutter and resultant downspout. In this construction the flaps 28 were selected to extend downwardly and inwardly into the gutter with dimensions substantially 1" long and 3/8" wide. Experimentation has shown that any leaves, twigs or debris of a size to fit within the slot 24, as partially blocked by the flap 28, was still of a size as would not clog the downspout with which such gutter was used, and permit the flow of rainwater therethrough.

As far as construction of the cover 12 of the invention is concerned, it will be understood that the top, front and bottom surfaces may be from separate materials, and then suitably shaped and joined in any appropriate and available manner, or formed from a single piece of material, shaped in cross-section by suitable manner known in the art. In such respects, the top and front surfaces of the invention can be merged into an outwardly rounded edge 80 to facilitate a smooth flow of rainwater from the top surface 14 onto the front surface 20, and from there, either by means of the flaps 28 or the wall interruptions 72 into the trough 26 of the gutter 10. In comparable manner, it will be appreciated that the flaps may be preferably formed integrally with the front surface 20 by stamping or die-cutting the flaps 28 out of the front surface 20, and by bending the flaps 28 generally inwardly and downwardly to the positions required. The slots 24 will then be appreciated to be formed or provided in the spaces in the front surface 20 where the flaps 28 had been bent and pushed back inwardly. One material which proved readily useful in constructing the cover of the invention was determined to be aluminum, or an aluminum alloy, which provided the resilient flexibility and strength required to be bent under the shingles of the roof, yet to withstand the forces of wind, rain and snow. Sheet-metal was found to be less desirable.

Figure 2:
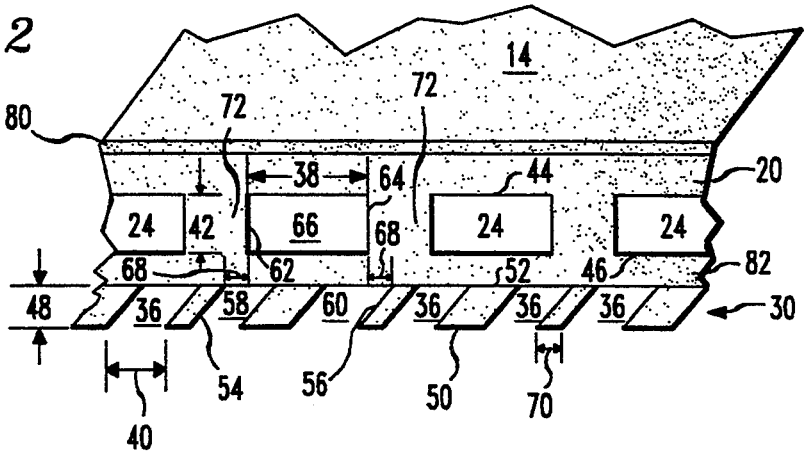
FIG. 2 is a partial view illustrating a slot in the front surface of the cover, helpful in an understanding of the invention.

As previously noted, another feature of the present invention, is the added strength it presents to the forces of wind, rain and snow—even beyond that presented in my pending Application, Ser. No. 07/935,978, filed Aug. 27, 1992, now U.S. Pat. No. 5,305,562. To be more specific, by separating the row 22 of interrupted slots 24 from the row 30 of the slots 36, a bulkhead or vertical wall 82 is presented. Any rainwater which flows across the wall 82 as draining down the vertical wall interruptions 72 continues to then flow into the interrupted slots 36, but the structure thus established between the lower edges 46 of the slots 24 and the rearward edges 52 of the slots 36 serve as a stiffener to strengthen the integrity of the overall gutter cover 12. An alternative construction—partially shown in the perspective view of FIG. 3 also utilizes a strip 84 in acting to provide the stiffening function, but this time in a construction where the interrupted slots 36 in the bottom surface 30 are created through a further bending action along the front and bottom surfaces 20, 30, respectively, as at the bend line 86—where, in this embodiment of the invention, the bottom slots 36 are of substantially the same width as the slots 24, and without any eccentricity. The stiffener 84 continues to provide increased structural integrity to the cover once secured in place by welding, or otherwise, and the bottom surface continues to lie below the plane of the lip 32 of the gutter 10. While continuing to retain that feature as in FIG. 1, any rainwater flow along the vertical wall interruptions 88 do not almost automatically fall within the interrupted slots of the horizontal surface, but substantially follow such a path. One advantage of the FIG. 3 embodiment, however, is its ease of manufacture, wherein it becomes a generally simple task to bend and shape the bottom surface 30 from the front surface 20. As with the FIG. 1 construction, on the other hand, the top and front surfaces can still be merged into an outwardly rounded edge, in facilitating the smooth flow of rainwater hitting the top surface 14. (Whereas the construction of FIG. 3 is shown with "slots" of dimension somewhat greater than those of the slots of FIGS. 1 and 2, it will be understood that neither of the views are for purposes of "specifying" what actual dimensions might be in a typical construction, but are illustrated merely for convenience in understanding the operation and teachings of the invention. It is assumed that this would be simply understood by those experienced in this field of construction.)

While there have been described what are considered to be preferred embodiments of the present invention, it will be readily appreciated by those skilled in the art that modifications can be made without departing from the scope of the teachings herein. Thus, whereas the present invention has been described in the context of utilizing the cover of the invention for a hollow rain gutter which is secured so as to receive the rainwater coming off of the roof of the dwelling or building to which the gutter is secured, if such roof is shingled, then by having the resiliently flexible top surface 14 fabricated of aluminum or aluminum-alloy material, it becomes a simple matter to insert the top surface 14 under the front row of shingles on the roof. However, the invention will be seen to operate equally as well where the top surface 14 is made to just abut the dwelling or structure even when an air-tight join is not made with facial board of the structure, especially where any space that exists is of insufficient size to permit any of the leaves, twigs or any debris from entering at that location. For at least such reason, therefore, resort should be had to the claims appended hereto for a true understanding of the scope of the invention.

I claim:

1. A rain gutter cover system of predetermined material for a hollow gutter of the type which is secured to the facia board of a structure, and which gutter incorporates a trough culminating in a defined front lip for receiving rainwater, said system further including rain gutter cover comprising:

an upwardly pitched top surface extending rearwardly to reach the facia board of said structure;

a bottom surface extending towards the front lip of said gutter, and with said bottom surface extending in a horizontal plane below the front lip of said gutter;

a downwardly pitched front surface extending between said top and bottom surfaces;

a first row of spaced-apart, interrupted slots running horizontally along said downwardly pitched front surface;

a plurality of rearwardly and downwardly extending flaps provided within said first row of spaced-apart interrupted slots for diverting rainwater into said gutter;

a second row of spaced-apart interrupted slots running horizontally along said bottom surface for diverting rainwater into said gutter which eludes said flaps;

with said first row of spaced-apart interrupted slots including upper and lower edges in horizontal planes above said front lip of said gutter;

and with said second row of spaced-apart interrupted slots including forward and rearward edges, at least one of which is in a horizontal plane below said front lip of said gutter;

whereby received rainwater flows along said top, front and bottom surfaces, and through said first and second rows of spaced-apart interrupted slots, into the trough of said gutter.

2. The rain gutter cover system of claim 1 for a hollow gutter of the type which is coupled to a downspout in use, and wherein said spaced-apart interrupted slots of said first and second rows are of dimension to prevent the passage of leaves of a size otherwise able to clog said downspout.

3. The rain gutter cover of claim 2 wherein the individual slots of said first row of spaced-apart interrupted slots are of a width greater than the width of the individual slots of said second row of spaced apart interrupted slots.

4. The rain gutter cover of claim 3 wherein the individual slots of said first row of spaced-apart interrupted slots are substantially $1\frac{1}{4}''$ in width and wherein the individual slots of said second row of spaced-apart interrupted slots are substantially $\frac{1}{2}''$ in width.

5. The rain gutter cover system of claim 4 wherein the individual slots of said first row of spaced-apart interrupted slots are substantially $\frac{1}{2}''$ in height.

6. The rain gutter cover system of claim 5 wherein said flaps are substantially 1" in length and 3/8" in width.

7. The rain gutter cover system of claim 2 wherein said second row of spaced-apart interrupted slots includes forward and rearward edges, both of which are in a horizontal plane below said front lip of said gutter.

8. The rain gutter cover system of claim 7 wherein said cover is fabricated of an aluminum or aluminum-alloy material.

9. The rain gutter cover system of claim 7 wherein said flaps are formed integrally with said front surface by stamping or die-cutting said flaps out of said front surface, and by bending said flaps generally inwardly and downwardly, with said first row of spaced-apart interrupted slots being then formed in the spaces in said front surface where said flaps have been bent inwardly.

10. The rain gutter cover system of claim 9 wherein said top surface and said front surface merge into an outwardly rounded edge to facilitate a smooth flow of rainwater from said top surface onto said front surface.

11. The rain gutter cover system of claim 7 wherein said flaps are formed integrally with said front surface by stamping or die-cutting said flaps out of said front surface, and by bending said flaps generally inwardly and downwardly, wherein said bottom surface is formed integrally with said front surface by bending said front surface forwardly and downwardly, with said second row of spaced-apart interrupted slots being then formed in said front surface where said first row of spaced-apart interrupted slots have been bent forwardly.

12. The rain gutter cover system of claim 11 also including a support strip extending horizontally across said front surface at said point of bending to integrally form said bottom surface.

13. The rain gutter cover system of claim 12 wherein said top surface and said front surface merge into an outwardly rounded edge to facilitate a smooth flow of rainwater from said top surface onto said front surface.

* * * * *